US005975796A

United States Patent [19]

Angel et al.

[11] Patent Number: 5,975,796

[45] Date of Patent: Nov. 2, 1999

[54] VERTICAL FLOW DIVERSION MAT SYSTEM

[75] Inventors: Thomas M. Angel, Houma; Robbie Boudreaux, Montegut; Ray Moore, Houma, all of La.

[73] Assignee: Submar, Inc., Houma, La.

[21] Appl. No.: 09/019,248

[22] Filed: Feb. 5, 1998

[51] Int. Cl.[6] ..... E02B 3/12

[52] U.S. Cl. ..... 405/28; 405/19

[58] Field of Search ..... 405/15, 16, 19, 405/20, 21, 24, 28, 31

[56] References Cited

U.S. PATENT DOCUMENTS

| | | | |
|---|---|---|---|
| 3,353,361 | 11/1967 | Lloyd | 405/28 |
| 3,842,606 | 10/1974 | Stiles et al. | 405/19 |
| 4,375,928 | 3/1983 | Crow et al. | 405/20 |
| 4,407,606 | 10/1983 | Larsen . | |
| 4,469,468 | 9/1984 | Larsen . | |
| 5,193,937 | 3/1993 | Miller . | |
| 5,449,020 | 9/1995 | Matiere . | |
| 5,476,343 | 12/1995 | Sumner . | |
| 5,846,023 | 12/1998 | Angel et al. | 405/20 |

FOREIGN PATENT DOCUMENTS

| | | |
|---|---|---|
| 2735135 | 7/1977 | Germany . |
| 7707168 | 6/1977 | Netherlands . |
| 962713 | 10/1982 | Russian Federation . |
| 1558427 | 1/1980 | United Kingdom . |
| 2084286 | 4/1982 | United Kingdom . |

*Primary Examiner*—David Bagnell
*Assistant Examiner*—Frederick L. Lagman
*Attorney, Agent, or Firm*—Wendy K. Bushop; Bayko Gibson et al

[57] ABSTRACT

A hanging articulated mat assemblage disposed between pilings or on a support structure using a plurality of elements connected with flexible rope to each other and to a support beam which permits the mat to swing freely while supporting substantial weight, and optionally using a nonabrasive pad disposed on selected faces of the elements to prevent abrasion while swinging of the mat.

14 Claims, 5 Drawing Sheets

VERTICAL FLOW DIVERSION MAT SYSTEM

FIELD OF THE INVENTION

The present invention relates to mats for dampening water and hydrodynamic effects. More particularly, the present invention relates to a unique hanging concrete assemblage mats to stabilize and protect shorelines, including ocean, stream river, and canal shorelines and banks from wave action, barge and boat wakes and ultimate erosion. There are numerous products that are attempting to prevent coastal erosion. This invention is a vertical hanging mat assemblage. The hanging mat will preferably be in the water instead of on the shoreline or bank.

BACKGROUND OF THE INVENTION

Articulated mats are used for offshore coastal and marine applications where separation, stabilization, protection and scour prevention is needed for pipelines and other installations submerged, partially submerged, or where shoreline, stream and river erosion protection is needed. These mats are particularly useful in areas where considerable hydrodynamic forces are generated currents and waves. Traditionally, seabed pipelines were covered with these types of mats for protection and stabilization of the pipeline however it is novel to consider hanging these mats for coastal restoration. Examples of articulated mats, their components, and their uses are given in European patent specification 0152232, and U.S. Pat. Nos. 2,876,628; 2,674,856; 4,370,075; 4,357,928; 4,417,828; 5,052,859; and 5,193,937.

Concrete is the preferred material in these mats because of its high tensile and compressive strength and its almost endless resistance to the action of natural types of water, including slowing water velocity. Unfortunately, concrete is hard and heavy. To help prevent erosion, hanging a concrete mat can be used to retard wave action associated with high tides, high wave action, tide surges and the like. The present invention is directed to hanging the mat between pilings or support structures, such that the mat can easily move with the tidal flows and wave action, yet provide resistance to erosion while simultaneously providing give and take with the water velocity.

There is a need in the art for dissipating wave energy, preventing erosion and restoring coastlines without being on the shoreline or on the embankment. In the instant invention, water can flow through the hanging mat which reduces the amount of force exerted against the mat. The mat elements are cast onto a rope so they cannot slide down the rope during use. Since the elements will not slide, the mat can be vertically hung. Also in the present invention, some elements can be removed to allow more water flow past them at yet, the entire mat will remain intact.

The present invention is related to dampening and flow diversion of water using a mat structure during high tides, high wave action and tide surges, without adding substantial weight to the bank. The present invention is particularly designed to dampen the wave action caused by barge and boat wakes. The improvement of the present invention relates to hanging the mats, while permitting one end of the mat to rest in the water and freely move back and forth with tidal currents or related water flows.

SUMMARY OF THE INVENTION

To hang an articulated concrete mat, the present invention provides a support structure for hanging, such as a pair of pilings or support pipes, made from metal, concrete, or a wood, or the equivalent, or a structure which resembles a pipe with a hook on it on which to support a mat. If pilings are used, then the mat can be suspended between the pilings. In a preferred embodiment, a mat is attached integrally at one end to a girder, permitting the mat to hang in a suspended manner from the girder in a free swinging manner.

The mats can be suspended with either steel cables having certain minimum tensile strengths or alternatively with stabilized rope capable of the same type of tensile strength support. Ideally the mats contains at least 160 elements for optimum stabilization of the shoreline although the invention can be made with only two elements.

One advantage of the present invention is that dampening can now be done without a rock structure. The instant invention is a thin mat structure, that when hung vertically provides significant cost savings for the same dampening effect. The mats elements, assist in energy dissipation due to the movement of the mat. The articulation of the lower mat elements helps prevent the mat from being undermined by scourer.

The mats are preferably integrally attached to a concrete beam or girder pilings or support structures are driven into the water near the shoreline. Then the articulating concrete mat with beam is integrated into the pilings or support structure, such as through disposing the beam or girder into notched grooves in the top most portion of the pile or support structure. The mat is suspended to permit movement back and forth of the concrete mats against the shoreline.

BRIEF DESCRIPTION OF THE DRAWINGS

For a further understanding of the nature and objects of the present invention, reference should be had to the following detailed description taken in conjunction with the following drawings in which like parts are given like reference numerals and wherein.

DETAILED DESCRIPTION OF THE PREFERRED EMBODIMENT

Figure 1:
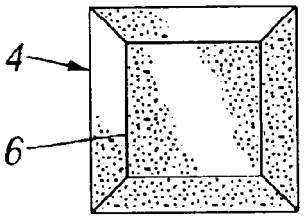
FIG. 1 a top view of a single concrete element ofthe preferred mat used with the present invention.

The primary purpose of the present invention is to use a certain articulated mat, preferably made from concrete, and optionally having non-abrasive pads disposed on at least a portion of the faces of the elements of the mats for protection of shorelines and other surfaces which are affected by wave action, the velocity of water including barge or boat wakes. The present invention can be used to protect natural shores and artificial structures from water action, boat wakes or weather action, without being on the shore itself. For purposes of the preferred embodiment, a concrete element mat will be shown as the preferred mat to be used with the mat installation between two pilings. Such mats which are shown in side view in FIG. 3 and perspective view in FIG. 10, have elements as shown in FIG. 1 which are made up of discrete elements 2, preferably a 12 inch square element shape on the bottom 4, having pyrimadic sides rising to an 8 inch square face 6. These size dimensions should not be considered restrictive of the present invention, but merely illustrative of sizes of elements that can be used in the present invention. Alternatively, the elements may be conical having a rounded base and a rounded top face which is approximately ¼ less in radius then the radius of the bottom side as opposed to the pyrimadic shape illustrated in FIG. 1. In the side view of FIG. 2, concrete element 2, has preferred dimensions of 4.5 inches in width with a 40 degree angle which angle can be plus or minus up to 12 degrees.

Figure 2:
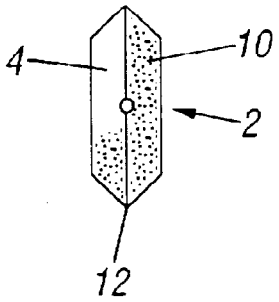
FIG. 2 is a side view of a single concrete element of the preferred mat used with the present invention.

The primary component of the mat is the concrete element 2. Although there are a number of suitable shapes in the prior art, the preferred embodiment of the mat shown in FIG. 1, is a basic pyrimadic shape. A conical structure can also be used. The best shape for the concrete element 2 is two symmetrically opposed pyramids as shown in the cross section of FIG. 2. If two symmetrically opposed pyramids are used, then the common rectangular base of the two opposing pyramids 8 and 10 form the center 12 of the concrete element 2. Each of the pyramids 8 and 10 is truncated at its top to form a face 6 as shown in FIG. 2. This hanging mat for stabilizing and protecting shoreline has a plurality of elements, at least two, wherein each of the elements has the shape of two symmetrically opposed geometric shapes wherein each geometric shape has a first face with a surface area which is 25% larger than the surface area of the second face the elements are arranged in parallel rows and columns with sufficient space between each of said elements to allow flexibility of movement.

Figure 7:
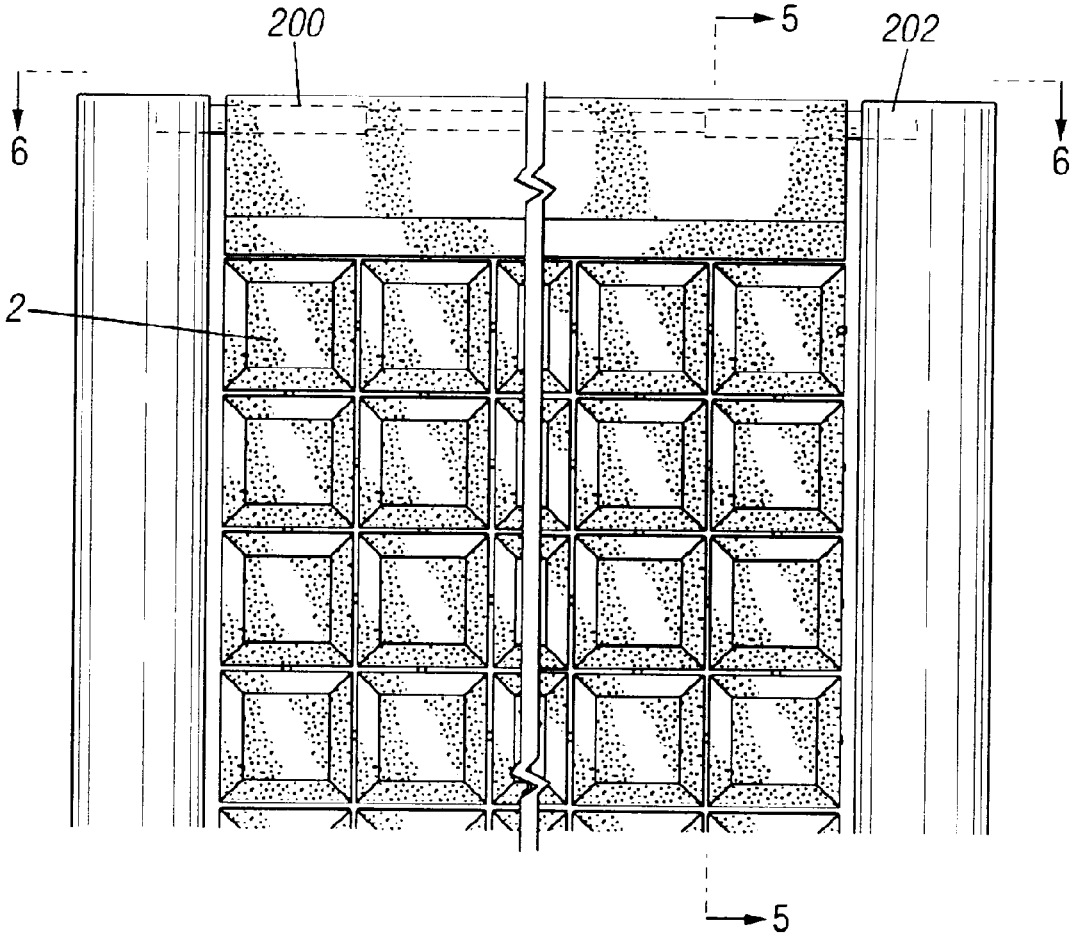
FIG. 7 is a top view ofthe mat for suspension with the concrete beam integrally attached to the mat.
Figure 9:
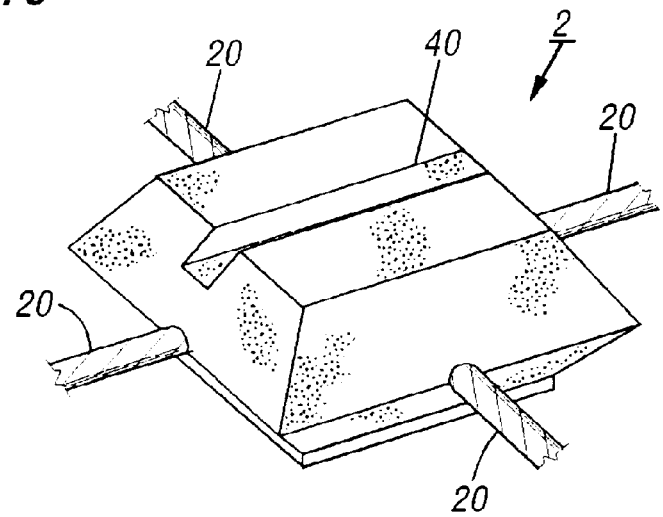
FIG. 9 is a perspective view of one element of the concrete mat with the flexible rope disposed within the element.

To make a useful mat 100, a plurality of concrete elements 2 are needed, up to 160 elements are preferred for use in the present invention for a mat size of 8 foot width by 20 foot length. It should be noted that as few as 2 elements wide and 1 element long may be used. Generally, mats in the range of 100 to 180 elements are contemplated but many different sizes of mats are contemplated in the present invention using a greater of small number of elements outside this range. The concrete elements 2 are arranged in a row and column array as shown in FIG. 7 and in FIG. 10. A flexible rope 20 as shown in FIG. 9 is used to attach the concrete elements 2 to one another. The rope can be made of a polymer or copolymer materials or even a flexible metal cable. In the preferred embodiment the rope 20 should be capable of withstanding at least an initial pressure of 8000 psi without breaking and more preferably 9500 pounds for mat movement and placement purposes. Further, the rope must be capable of being embedded in the wet concrete during the mat making process without difficulty. The best ropes are 3 strand braided fiber rope or metal cable which is capable of withstanding ultraviolet light without degrading and having a minimum tensile strength of 9500 pounds.

Figure 6:
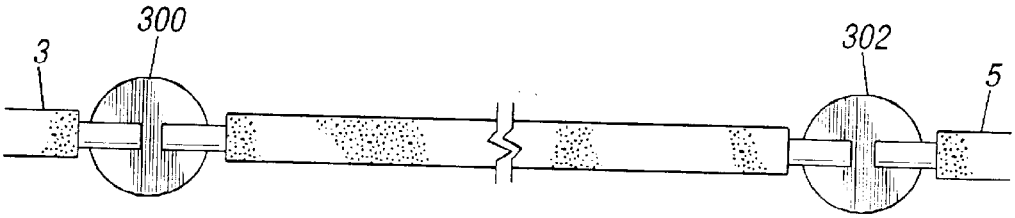
FIG. 6 is a plan view of a suspended mat with concrete beam between two pilings.
Figure 10:
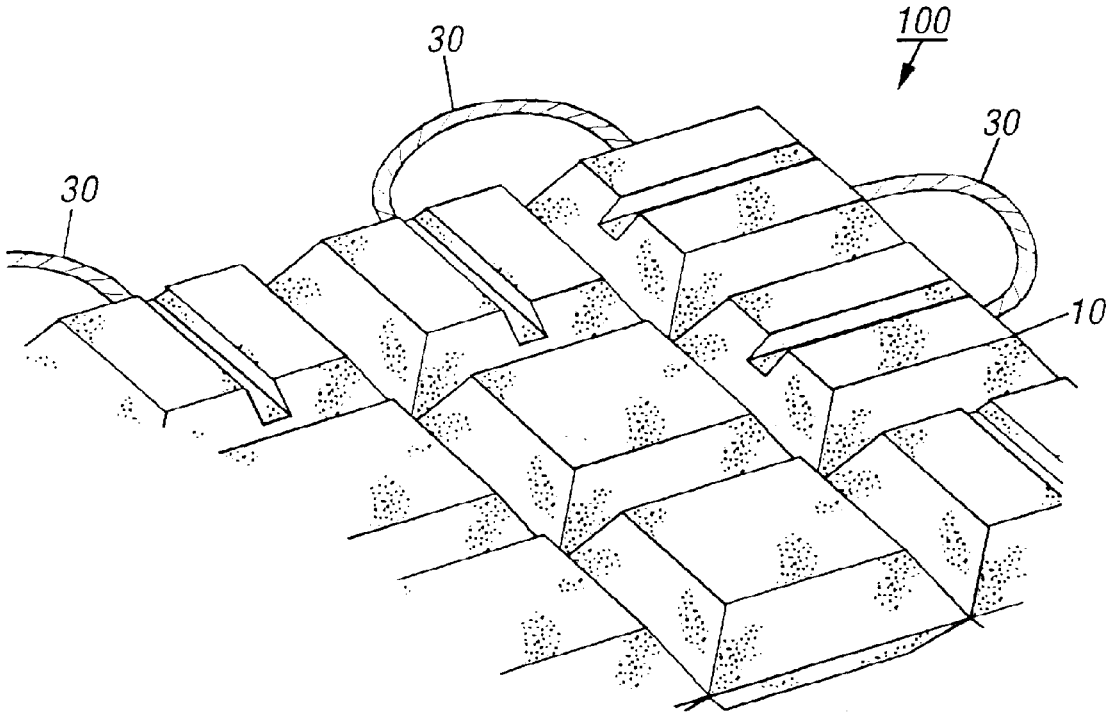
FIG. 10 is a perspective view of one of the mats showing the side loops which can attach to the concrete beam.

The rope 20 is preferably embedded in the concrete so as to leave a small loop 30 at the exit and entrance of alternating rows and columns in the rope grid layout as shown in FIG. 10 and on all four sides of the mat 100. These small loops 30 are used to facilitate the handling and transportation of the mat 100 and during installation of the mat 100 they are integrated into a concrete beam or girder which is used to support the mat on the pilings. In the preferred embodiment, the ropes are encased in a reinforced concrete beam on one side of the mat. The beam dimensions will vary depending on the water depth for the hanging mat, the wave height, current velocities and other forces working against the structure. This beam will allow the mat to hang vertically, suspended between two piles or one or more support structures. These mats can be placed end to end along a coastline to dissipate wave energy, prevent erosion and under the right conditions, cause sedimentation behind the structure. These structures will be used for coastal restoration or flow diversion in creeks, rivers to prevent erosion. FIG. 6 shows a plan view of the hanging mat 100 hanging from two pilings 300 and 302 and connected to an additional mat 3 and an additional mat 5, showing the mats connected together, over the pilings, forming a line of hanging mats which can protect a shoreline or partially submerged structure, such as a bulkhead.

Figure 3:
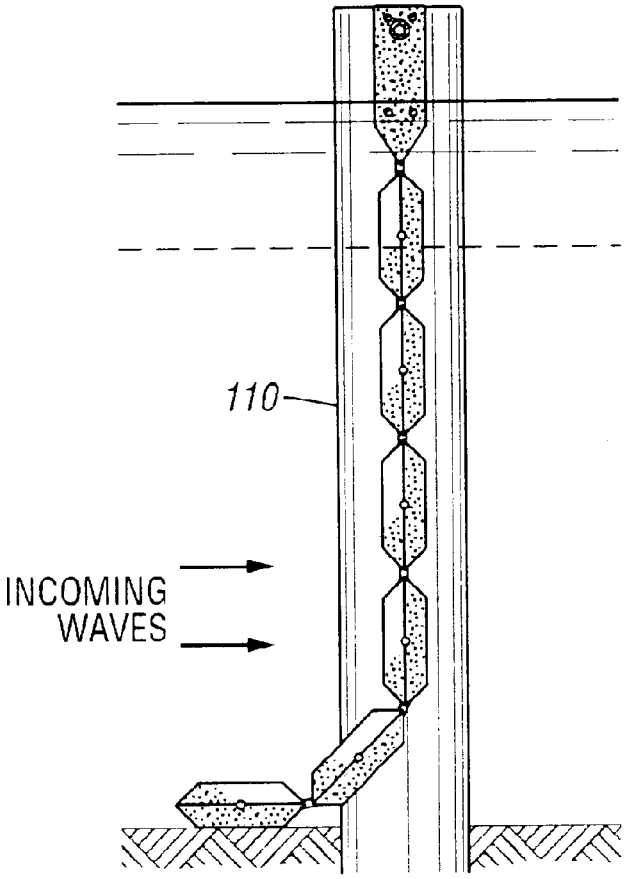
FIG. 3 is a side view of an assembled mat hanging between the pilings with the concrete beam of the present invention.
Figure 11:
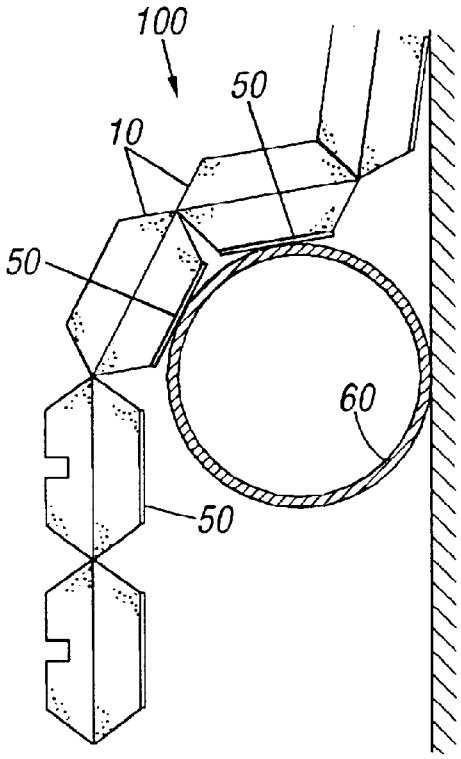
FIG. 11 shows an alternative embodiment of the hanging mat assemblage having an anti-abrasive pad on cerain faces of the elements of the mat as the elements go around a pipe projecting from the side of wall against which the mat is hung.
Figure 12:
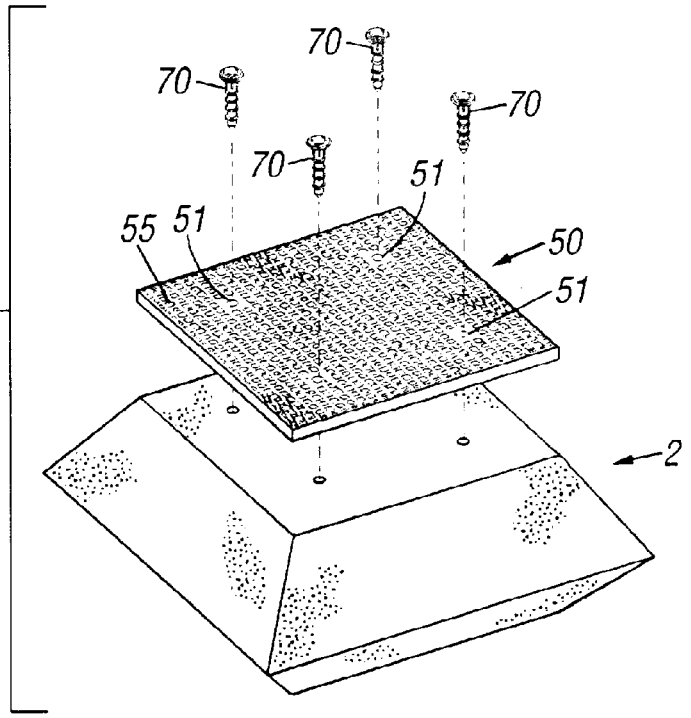
FIG. 12 is an exploded version of the non-abrasive pad attached to an element of the mat.

As mentioned before, the purpose of the unique hanging mat 100 used in the present invention is the protection of and the stabilization of the shoreline, seabed, riverbed, particularly from wave action as shown in FIG. 3. Some installations may optionally use a non-abrasive pad 50 attached to at least one face 6 of the concrete element 2 as shown in FIG. 11. In an alternative embodiment, where the hanging mat is hanging against a structure rather than out in the water, the non-abrasive pad 50 is situated between the concrete element 2 and a projecting structure 60 which may need protection from abrasion by the concrete elements. The structure may also need cathodic protection which is also provided by the unique anti-abrasive pads shown in the present invention. The anti-abrasive pads of the present invention preferably have a structure as shown in FIG. 12 wherein the pad 50 has polymeric fasteners 70 which are passed through the anti-abrasive pad 50 using orifices 51 while the concrete element is still not completely cured, the fasteners are nonadhesively attaching the nonabrasive pads to the faces of the elements 2. The pads of this structure permit the flow of ions away from metal structures, causing cathodic protection of a metallic submerged or partially submerged installation. Alternatively, the anti-abrasive pads could be adhesively attached to the faces of the elements. The preferred mat 100 with pad 50 is constructed so as to permit ion flow through the pad in water to the installation. This ion flow improves cathodic protection of the installation if it is a metal bulkhead. The mat 100 can be used with a novel frame system for disposing these protective mats with non-abrasive pads onto the pilings contemplated by the present invention, the frame will let the mats be airlifted by helicopter to the preferred site and then positioned on the pilings. The best material for the non-abrasive pad 50 is low-density polyethylene ("LDPE") although polyvinyl chloride ("PVC") and nylon also work well. Any polymer substance capable of sustaining weight for concrete elements can be used for the pad, as long as it remains flexible at cold temperatures.

Figure 13:
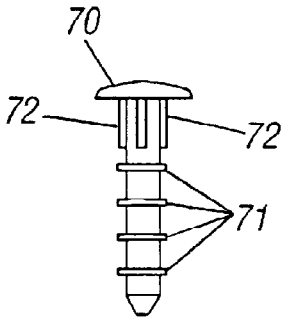
FIG. 13, is the profile of a fastener used in the present invention attaching the pad to the mat.

As shown in FIG. 12, the non-abrasive pad 50 is attached to the concrete element 2 by fasteners 70 at the hole 51 of the non-abrasive pad 50. A profile of a fastener 70 is shown in FIG. 13. Although the fasteners 70 may be placed into the element 2 by a variety of means, it is best to form the concrete element 2 around the fastener 70 to provide the most secure attachment of the nonabrasive pad 50 to the element 2.

The best material for the fastener 70 is nylon. Suitable materials are polyvinyl chloride (PVC) and low density polyethylene (LDPE). The fastener, like the pad, must be capable of resisting brittleness at temperatures found in cold climates. Other non-metallic materials can be substituted for nylon if those materials are not abrasive to the installation and the substitute material does not deteriorate significantly in sea water or become brittle at low temperatures. In the most advantageous configuration, four fasteners are fitted onto each non-abrasive pad 50 and the concrete element 2 is formed around the fasteners ribs 71 of the fastener 70.

In the preferred embodiment the pad 50 is attached to the concrete element using the fasteners 70 while still wet. In the optimum configuration, pad 50 contains an array of openings 55 as shown in FIG. 12. The openings 55 serve a dual function. They allow the ions to flow through the nonabrasive pad to metal installations, if the invention is hung around a pipe or bulkhead, preventing rusting, corrosion or similar deterioration of the metallic structure, and causing cathodic protection of the metallic structure.

Figure 4:
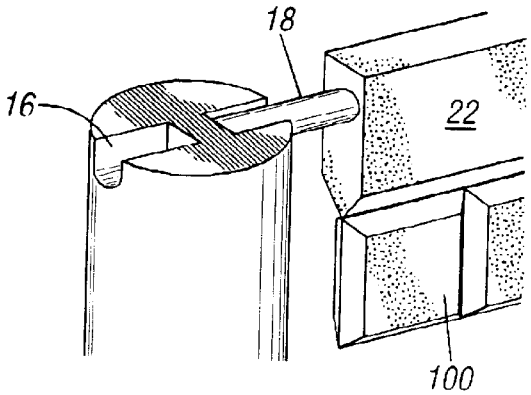
FIG. 4 is a side view of the concrete beam as placed in the notched top of a piling.

To support the articulating concrete mat 100 in a hanging position, as shown in FIG. 3, the present invention provides pilings made of steel 110, such as a piling having an eight inch radius, cut so as to have notches 16 in the top to receive side bars 18 which are extended bars from the primary section of cement beam 22 which extends out from the edge of the beam as shown in FIG. 4.

Figure 5:
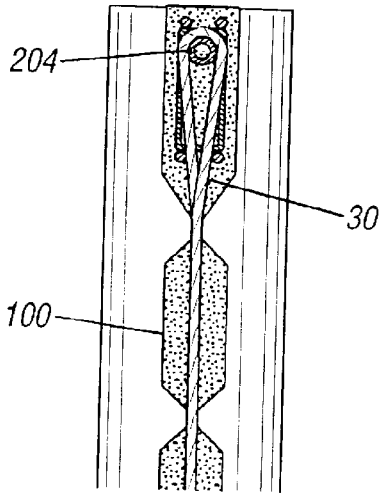
FIG. 5 is a side view of the concrete mat as it is embedded in the concrete beam of the present invention.

The cement beam as shown in FIGS. 4 and 5 and again in FIG. 7, is integrally connected to the concrete mat 100. The beam provides support and resiliency and is preferably cast at the same time as the concrete elements 2 are cast, although the elements could be cast first. The rope of the element is looped around a pipe which traverses the beam or girder. The pipe is reinforced with rebar then cement is poured forming a cast concrete beam.

The method of making the hanging mat installation for protecting and stabilizing a bulkhead or shore from hydrodynamic forces such as boat wakes, basically involves the steps of first, creating a mold having a plurality of units wherein each of the units are arranged in parallel rows and columns with space between each of the units. Next a rope is laced over or through each of the mold units so that the rope will become an integral with each unit, connecting the units together in a row and column array with space between each unit. The rope, as mentioned above is further looped around a pipe contained within a supporting beam mold. The pipe is further supported by rebar to add strenght to the ultimate cast beam. Either prior to putting the rope in the mold or just after, the mold is sprayed with a mold release agent, such as fish oil or teflon. Then the casting material is poured into the mold. The casting material is preferably concrete, but other substances could be used to achieve the same results. The mold units are allowed to cure into the components known as elements and the cast beam. Next, the units as cast and beam are released from the mold. It should be mentioned, that prior to curing, an extra step of aspirating the molds with air or vaccum may be done to remove large bubbles from the casting material after it is poured but before it is hardened. Next the cast mat and beam are taken to the hanging site which has been prepared by driving the pilings or support structure into the land. Then the beam is disposed on the support structure or hung such that a portion of said mat swings freely thereby protecting the shoreline or underlying structure without placing the full weight of the mat on said shoreline or underlying structure.

Figure 8:
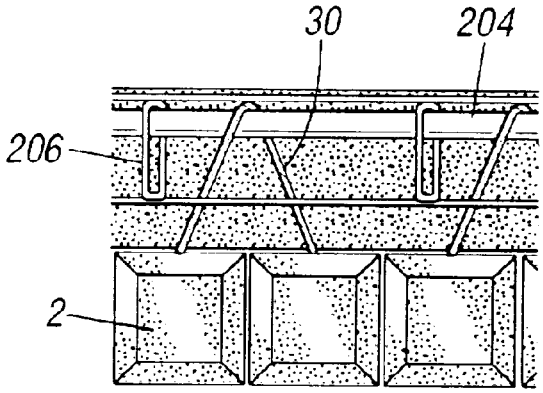
FIG. 8 is a cross section view of the inside of the concrete beam with the mat attached.

In a preferred embodiment, the concrete beam 200 as shown in FIG. 7, has extending fingers 202 which are capable of engaging with the notches in the pilings as shown in FIG. 3. The beam 200 is constructed, as shown in FIG. 8, from a pipe 204 around which the rope loops 30 are disposed. The beam height and width will vary. The preferred standard is 14 inches by 6 inches. The diameter of the pipe will vary as well but it is preferred that a standard 2 inch diameter steel pipe be used. The pipe is supported with reinforcing bars of rebar 206 which may be steel or fiberglass, or other corrosion resistant material. The attachment means of the beam to the piling may vary because of site requirements but the notches is the cheapest fastest way for the present invention. Once the rope is looped around the pipe 204 cement or cement reinforced with other materials or mixed with additives may be poured around the assembled beam and cured. Occasionally, the concrete prior to curing may need to be aspirated to remove bubbles which may develop during assemblage. Additives which may be added to the concrete to enhance stability or lessen costs, can be, for example fiberglass and flyash provided the optimum strength is still achievable for the beam and deterioration of the beam is deterred.

In the most preferred embodiment, the mat 100 is of a dimensions of 8 feet×20 feet×4 and ½ inches. The mat could be as short at 1 foot or as long as two feet. The length to width ratio is preferably 1:4. The typical mat weight will be, in air, 5500 pounds, and in a submerged situation 3,500 pounds. The concrete density preferably is 145 pounds per cubic foot and the strength is preferably 4000 psi although the density could be less or greater depending on the needed end use.

Although the present invention is described and illustrated above with detailed reference to the preferred embodiment, the invention is not limited to the details of such embodiment but is capable of numerous modifications, by one of ordinary skill in the art, within the scope of the following claims.

We claim:

1. A hanging mat for stabilizing and protecting shoreline comprising:

a plurality of elements wherein each of said elements has the shape of two symmetrically opposed geometric shapes wherein each geometric shape has a first face with a surface area which is 25% larger than the surface area of the second face;

said elements are arranged in parallel rows and columns with sufficient space between each of said elements to allow adjacent elements to swing flexibly with respect to each other;

a flexible rope, said rope constructed and arranged to pass through said center of each of said elements in two directions and embedded therein to fasten said elements to each other by said rows and by said columns and said rope having loops which can be fastened around a pipe in a support beam; and a support beam comprised of pipe and rebar which is integrally attached to one side of a plurality of elements, then cast with a material capable of forming a strong and resilient substance forming a cast structure, said cast structure being capable of supporting the weight of a plurality of said elements and hanging from a support structure.

2. The hanging mat of claim 1, wherein each element has the shape of two symmetrically opposed pyramids, each of said pyramids having a truncated top forming a face, each of said pyramids further having a common rectangular base that forms a center of said element.

3. The hanging mat of claim 1, wherein each element has the shape of two symmetrically opposed cones, each of said cones having a truncated top forming a face, each of said pyramids further having a common circular base that forms a center of said elements.

4. The hanging mat according to claim 1, which is supported on at least two pilings by attaching means on each end of said support beam.

5. The hanging mat according to claim 1, further comprising a non-abrasive pad attached to at least one face of one or more of said plurality of elements.

6. The hanging mat according to claim 1, wherein said flexible rope includes a small loop at the exit and entrance of alternating rows and alternating columns for the purpose of handling said elements during transportation and installation and attaching to said pipe.

7. The hanging mat of claim 1 having from 2 to 160 elements.

8. The hanging mat of claim 1, wherein said elements and said cast structure are prepared from concrete.

9. The hanging mat of claim 8, wherein said cement further comprises additives and fillers which enhance resiliency and improve stability of the elements.

10. A method of making a hanging mat installation for protecting and stabilizing a bulkhead or shore from hydrodynamic forces comprising the steps of:

creating a mold having a plurality of units wherein each of said units are arranged in parallel rows and columns with space between each of said units;

lacing a rope through said units so that said rope is integral in each unit to connect units to each other in a row and column array with space between each unit and further looping said rope around a pipe contained within a supporting beam mold;

spraying a mold release agent on the molds;

pouring concrete into said units and beam mold, allowing the units to cure into elements and a beam;

releasing elements and beam from the mold; and disposing the beam with integral mat attached on a support structure, hanging said mat such that a portion of said mat swings freely to protect a shoreline or underlying structure without placing the full weight of the mat on said shoreline or underlying structure.

11. A method for making a hanging mat installation according to claim 10, further comprising the step of affixing integrally to one or more of said plurality of elements a non-abrasive pad.

12. The method of claim 10 wherein the mold release agent is fish oil.

13. The method of claim 10, further comprising the step of aspirating the concrete after it is poured into the molds.

14. The method of claim 10, wherein the support structure is a pair of pilings.

* * * * *